US007568340B2

(12) United States Patent
Marsal et al.

(10) Patent No.: US 7,568,340 B2
(45) Date of Patent: Aug. 4, 2009

(54) EXHAUST GAS RECIRCULATION MIXER

(75) Inventors: Damien Marsal, Golbey (FR); Junfei Yin, Cranfield (GB); Nicolas Deschatrettes, Wigan (GB); Joan-Pierrs Toniolo, Chavelot (FR); Ocean Han, Shanghai (CN)

(73) Assignee: Honeywell International, Inc., Morristown, NJ (US)

( * ) Notice: Subject to any disclaimer, the term of this patent is extended or adjusted under 35 U.S.C. 154(b) by 28 days.

(21) Appl. No.: 11/440,234

(22) Filed: May 24, 2006

(65) Prior Publication Data

US 2007/0271920 A1 Nov. 29, 2007

(51) Int. Cl.
*F02B 33/44* (2006.01)
*F02M 25/07* (2006.01)
*F02M 25/06* (2006.01)

(52) U.S. Cl. ..... 60/605.2; 123/568.17

(58) Field of Classification Search ..... 60/605.2; 123/568.17; *F02M 25/07, 25/06*
See application file for complete search history.

(56) References Cited

U.S. PATENT DOCUMENTS

| | | | | |
|---|---|---|---|---|
| 2,354,179 | A * | 7/1944 | Blanc | 123/568.17 |
| 4,461,150 | A * | 7/1984 | Grohn | 123/568.17 |
| 6,928,993 | B2 * | 8/2005 | Yu | 123/568.17 |
| 7,243,641 | B2 * | 7/2007 | Zukouski | 123/568.17 |
| 2006/0042245 | A1 * | 3/2006 | Wimmer et al. | 60/605.2 |
| 2006/0060171 | A1 | 3/2006 | Liu et al. | 12/568.17 |
| 2007/0144170 | A1 * | 6/2007 | Griffith | 60/605.2 |
| 2007/0256413 | A1 * | 11/2007 | Marsal et al. | 60/605.2 |

FOREIGN PATENT DOCUMENTS

| | | | |
|---|---|---|---|
| DE | 19809862 | A1 * | 9/1999 |
| DE | 19910781 | A1 * | 9/2000 |
| EP | 1152141 | A1 | 5/2000 |
| EP | 1213469 | A2 | 7/2001 |
| JP | 09133052 | A * | 5/1997 |
| JP | 2005147010 | A * | 6/2005 |
| JP | 2006132373 | A * | 5/2006 |
| JP | 2007092592 | A * | 4/2007 |
| JP | 2007154675 | A * | 6/2007 |
| KR | 2006058334 | A * | 5/2006 |
| WO | WO 9943943 | A1 * | 9/1999 |
| WO | 03/067044 | A1 | 8/2003 |
| WO | 2004/044406 | | 5/2004 |

OTHER PUBLICATIONS

ISR/WO PCT/US2007/069261.

* cited by examiner

*Primary Examiner*—Thai Ba Trieu
(74) *Attorney, Agent, or Firm*—Lee & Hayes

(57) ABSTRACT

The present invention provides an exhaust gas recirculation mixer for use with a long route (i.e., low pressure) EGR system adapted for use in a turbocharged internal combustion engine. The mixer comprises an outer wall and an inner wall defining a cavity therebetween, a chamber defined within the inner wall, an exhaust gas inlet on the outer wall, and apertures of varying dimensions disposed within the inner wall so that exhaust gas enters the mixer in a controlled flow through the exhaust gas inlet, through the cavity, and through the apertures into the chamber for mixture with ambient air.

8 Claims, 3 Drawing Sheets

EXHAUST GAS RECIRCULATION MIXER

CROSS-REFERENCES TO RELATED APPLICATIONS

Not Applicable.

BACKGROUND OF THE INVENTION

1. Field of the Invention (Technical Field)

The present invention relates to internal combustion engine exhaust gas recirculation (EGR), particularly to an EGR mixer apparatus for maximizing EGR rates and lowering emission levels.

2. Description of Related Art

Note that the where the following discussion refers to a number of publications by author(s) and year of publication, due to recent publication dates certain publications are not to be considered as prior art vis-a-vis the present invention. Discussion of such publications herein is given for more complete background and is not to be construed as an admission that such publications are prior art for patentability determination purposes.

In the reduction of NOx emissions by turbocharged internal combustion engines, exhaust as recirculation ("EGR") such as long route EGR systems ("LREGR") (also known as low pressure loop or long path EGR systems) take exhaust gas from a point downstream of the exhaust of the turbocharger exhaust turbine to the turbocharger compressor and on to the intake manifold of the engine. The exhaust gas is typically mixed with fresh air in an EGR mixer prior to introduction into the intake manifold.

The flow characteristics of exhaust gas as it enters and moves through the EGR mixer affect the efficiency of the mixing of the exhaust gas with ambient air, and therefore the effectiveness of the reduction of emissions. Therefore, there is a need for an EGR mixer that improves the mixing of exhaust gas with ambient air.

BRIEF SUMMARY OF THE INVENTION

The present invention provides an exhaust gas recirculation ("EGR") mixer for use with a long route EGR system for enhancing and controlling EGR rate, flow, and pressure.

An embodiment of the present invention provides an EGR mixer for use in a long route EGR system, said mixer comprising an outer wall, an inner wall (said inner and said outer walls defining a cavity therebetween), a chamber defined within the inner wall, a plurality of apertures in the inner wall, an exhaust gas inlet disposed on the outer wall for receiving exhaust gas into the cavity then into the chamber through the apertures, the apertures closer to the exhaust gas inlet having smaller diameters than those further from the exhaust gas inlet, a fresh air inlet at a first end of the mixer for receiving air into the chamber for mixing with exhaust gas, and an air outlet at a second end of the mixer for the exit of a mixture of fresh air and exhaust gas. In one embodiment, an axial cross-section of each of the apertures is at substantially a 90° angle with respect to a longitudinal axis of the chamber.

The apertures are preferably disposed in pairs, each aperture in a pair having similar angular positions about the chamber, an angle of a first aperture measured counterclockwise from a longitudinal axis of the exhaust gas inlet and an angle of the second aperture measured clockwise from a longitudinal axis of the exhaust gas inlet. Preferably, a sum of an axial cross-sectional area of each of the apertures is substantially equal to an axial cross-sectional area of the exhaust gas inlet.

Preferably, the inner wall and the outer wall are offset in relation to each other such that a distance between the inner wall and the outer wall progressively decreases from a point adjacent the exhaust gas inlet to a radially opposite side of the cavity.

Another embodiment provides an internal combustion engine system comprising an internal combustion engine comprising an exhaust manifold with an exhaust outlet and an intake manifold with an intake air inlet, a turbocharger comprising an exhaust gas turbine and a compressor, said exhaust gas turbine in fluidic connection with the exhaust outlet to receive exhaust gas, and an EGR mixer in fluidic connection with the exhaust turbine to receive exhaust gas and in fluidic connection with a fresh air inlet to receive fresh air for mixing with the exhaust gas, said EGR mixer as described above and in fluidic connection with the compressor so that the compressor receives a mixture of the fresh air and the exhaust gas, the compressor in fluidic connection with the intake air inlet.

Another embodiment provides a long route EGR system for use with an internal combustion engine, the engine having an exhaust manifold with an exhaust manifold outlet and an intake manifold with an intake manifold air inlet, said system comprising a low pressure EGR loop in fluidic connection with the exhaust manifold outlet and the intake manifold air inlet, a turbocharger having an exhaust gas turbine and a compressor, an EGR mixer downstream of the exhaust gas turbine, with a first portion of the low pressure EGR loop in fluidic connection with the EGR mixer and with the exhaust gas turbine to receive exhaust gas from said exhaust gas turbine, a fresh air inlet in fluidic connection with the EGR mixer, said EGR mixer as described above, a second portion of the low pressure EGR loop in fluidic connection with the EGR mixer and with the compressor, and a third portion of the low pressure EGR loop in fluidic connection with the compressor and with the intake manifold air inlet.

An object of the present invention is to enhance EGR rate and flow to better reduce emissions.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into, and form a part of, the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention provides an exhaust gas recirculation ("EGR") mixer for use with long route EGR ("LREGR") systems and a system comprising the EGR mixer. The present invention provides for a constant EGR flow and a minimum of pressure loss for the EGR flow.

It is understood that EGR applications may include short route (i.e., high pressure) EGR, LREGR, or a combination of both (i.e., dual EGR systems). The present invention is applicable to the LREGR system regardless of the overall EGR system or system combination utilized.

As used in the specification, including the claims, herein, the terms "a", "an", and "the" mean one or more.

Generally, the present invention encompasses an EGR mixer for use with an LREGR loop for use in an internal combustion engine. In the LREGR loop, an exhaust gas turbine that is in fluidic connection with the engine's exhaust manifold is put in fluidic connection with the EGR mixer so that the EGR mixer receives exhaust gas. The EGR mixer is also in fluidic connection with a fresh air inlet to receive fresh air for mixing with the exhaust gas. The EGR mixer is also in fluidic connection with the turbocharger compressor so that after a mixture of fresh air and EGR gas is achieved, the mixture is sent to the compressor and on to the intake manifold of the engine.

Figure 1:
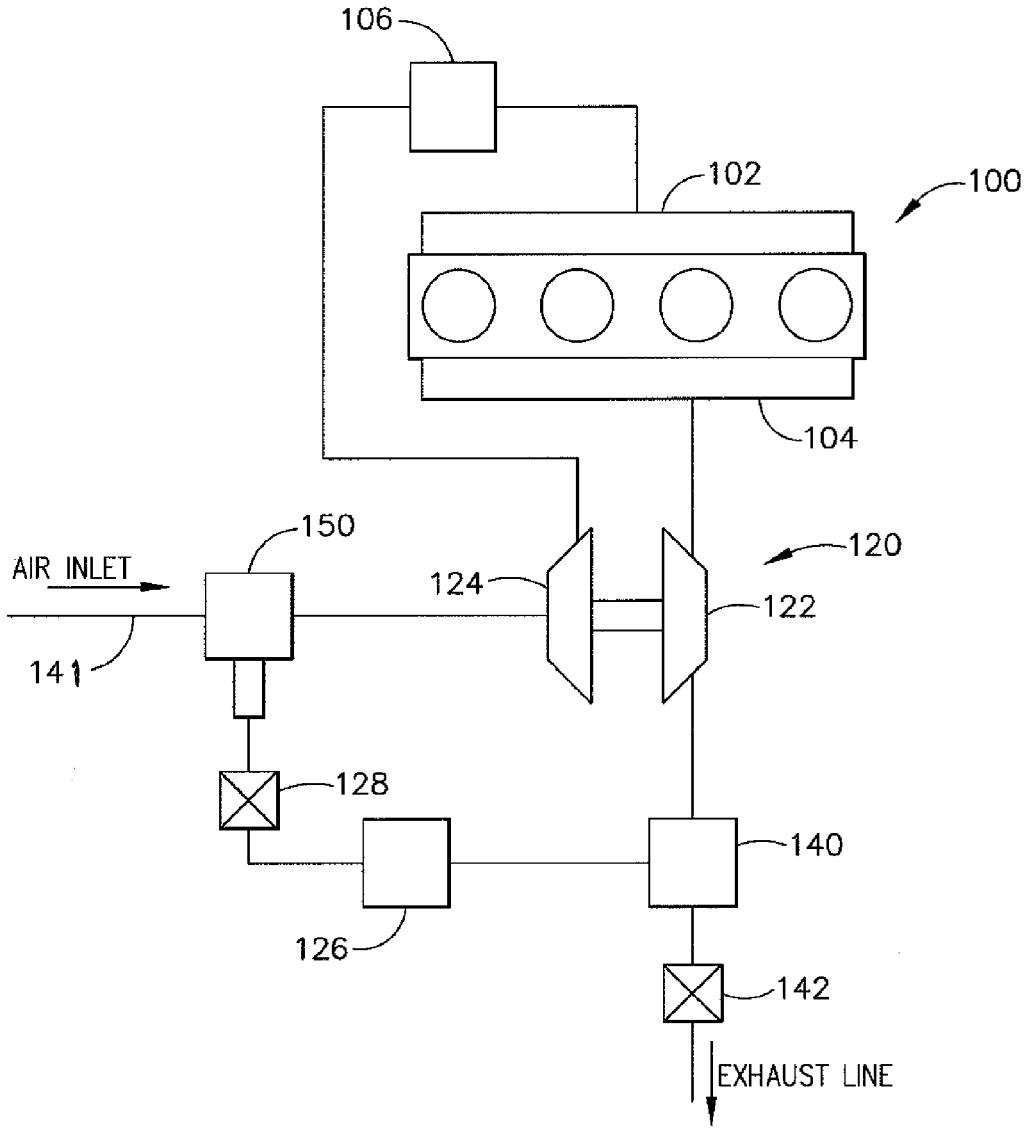
FIG. 1 is a schematic diagram of an embodiment of the present invention showing an engine and exhaust gas recirculation ("EGR") system.
Figure 2:
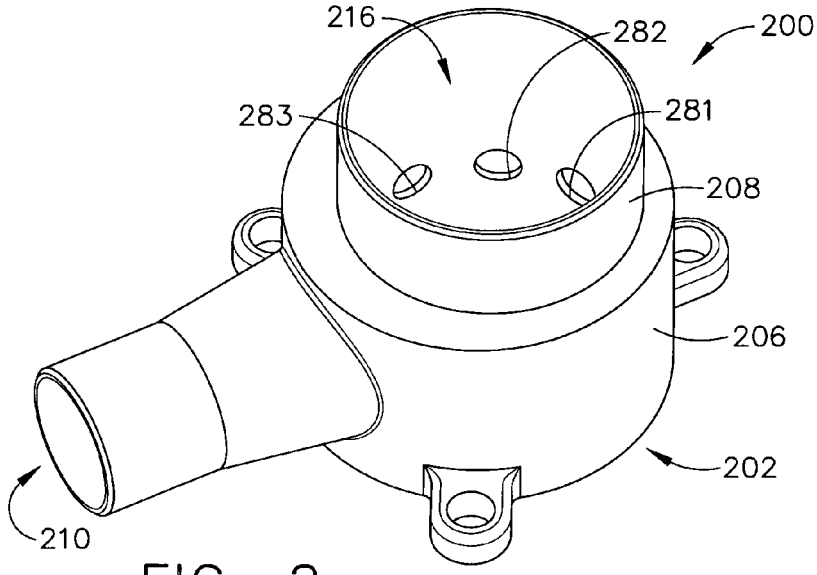
FIG. 2 is a perspective view of an embodiment of an EGR mixer of the present invention.
Figure 3:
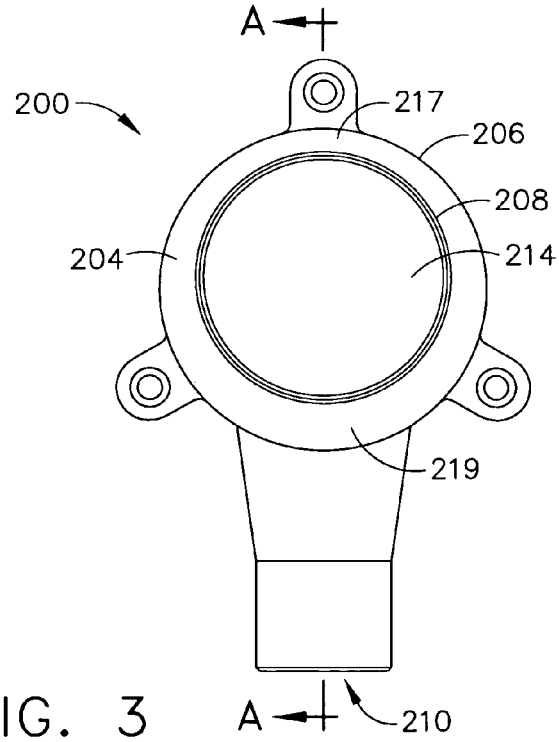
FIG. 3 is a top view schematic of the EGR mixer of FIG. 2.

Turning now to the figures, which describe non-limiting embodiments of the present invention, FIG. 1 is a schematic diagram showing a turbocharged engine and an EGR system employing a LREGR and EGR mixer. Engine 100 is shown with at least one cylinder in communication with intake manifold 102 and with exhaust manifold 104. Turbocharger 120 is shown with exhaust turbine 122 downstream of exhaust manifold 104 and upstream of optional emissions controller 140 which may comprise, for example, a diesel particulate filter. Downstream of emissions controller 140 is exhaust flap 142. In the LREGR system, exhaust gas is diverted from exhaust manifold 104 to exhaust turbine 122, through emissions controller 140 and on to cooler 126. Exhaust gas is then sent through low pressure EGR valve 128 to EGR mixer 150 for mixing with fresh air coming into EGR mixer 150 from fresh air intake line 141. The mixture of EGR gas and fresh air is sent to turbocharger compressor 124. The fresh air/exhaust gas mixture is sent from compressor 124 through cooler 106 to enter intake manifold 102.

FIGS. 2-5 show a representative embodiment of an EGR mixer 200 for use in the LREGR system described herein. Mixer 200 comprises tubular housing 202, at least a portion of which is double-walled so that cavity 204 is defined between housing outer wall 206 and housing inner wall 208. Exhaust gas flows through tubular mixer opening/inlet 210, then through a plurality of chamber apertures/inlets 281-285 and 281'-285' into chamber 214. Although ten apertures are shown in the embodiment, the number of apertures may vary depending on the application, size requirements, etc. Fresh air flows through opening 216 into chamber 214 where it is mixed with exhaust gas, the mixture then flowing out of chamber 214 through opening 218 to enter compressor 124.

Figure 4:
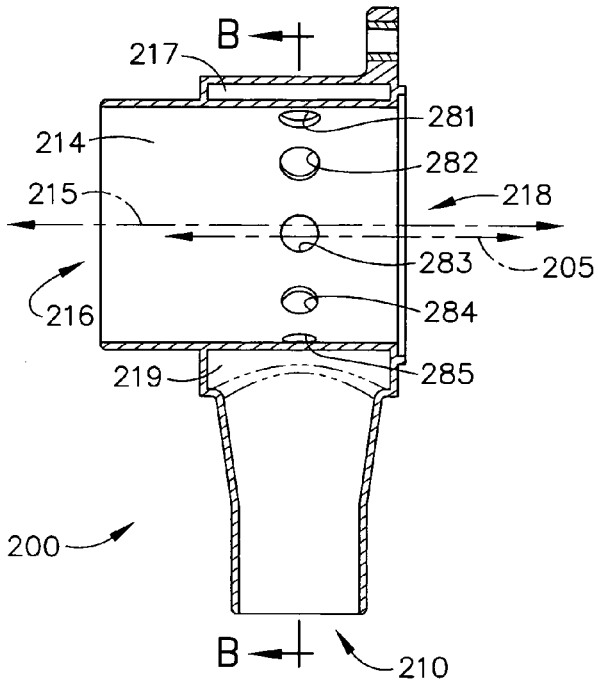
FIG. 4 is a schematic of the A-A cross-section of the EGR mixer as shown in FIG. 3.
Figure 5:
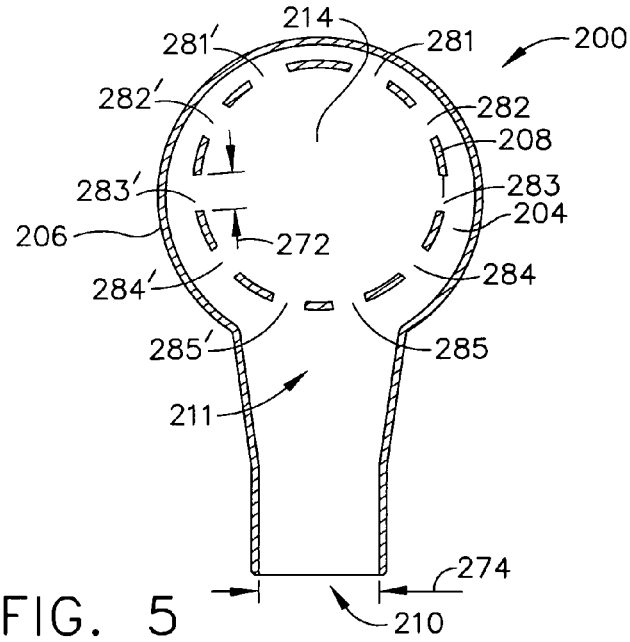
FIG. 5 is a schematic of the B-B cross-section of the EGR mixer as shown in FIG. 4.

Apertures 281-285 and 281'-285' are disposed in inner wall 208 so that the axis of each aperture is at an angle, such as a substantially 90° angle, to the axis 215 of chamber 214 (shown in FIG. 4). Outer wall 206 and inner wall 208 are offset so that the longitudinal axis 215 of chamber 214 is offset from the axis 205 of the diameter defined by inner wall 208. In other words, outer wall 206 and inner wall 208 are offset in relation to each other so that a distance between outer wall 206 and inner wall 208 progressively decreases from a point adjacent cavity entry 211 (shown in FIG. 5) to a radially opposite side of cavity 204. Therefore, space 219 between outer wall 206 and inner wall 208 is larger than space 217 between outer wall 206 and inner wall 208. The diameters of apertures 281-285 and 281'-285' are such that the diameters of the apertures closest to inlet 210 are less than that of the apertures further away from exhaust gas inlet 210. Thus, the flow of EGR gas through cavity 204 and apertures 281-285 and 281'-285' into chamber 214 is controlled and moderated to ensure optimum flow rate, pressure, and mixing with air coming through opening 216 into chamber 214.

The dimensions of apertures 281-285 and 281'-285' and other features of EGR mixer 200 vary depending on the size of the turbocharger to which the EGR mixer will be connected. Preferably, apertures 281-285 and 281'-285' disposed in sets of two, each aperture in a pair having similar angular positions about chamber 214, with an angle of a first aperture in a set measured counterclockwise from a longitudinal axis of exhaust gas inlet 210 and an angle of the second aperture in the set measured clockwise from the longitudinal axis of exhaust gas inlet 210.

Also, the dimensions of the apertures preferably are designed in reference to the diameter of exhaust gas inlet 210. In one embodiment, illustrated in the figures, the relationship is such that the sum of an axial cross-sectional area of each of the apertures (such as the area derived from diameter 272 of aperture 283' which is representative of the diameters of the other apertures) is substantially equal to an axial cross-sectional area of exhaust gas inlet 210 (said area derived from diameter 274).

The EGR mixer of the present invention may be disposed in the LREGR system in any manner understood in the art to function as described herein. For example, the EGR mixer can be integrated to the turbocharger compressor inlet or fixed/attached to the compressor inlet with a fresh air conduit and an exhaust gas conduit connected to the EGR mixer.

EXAMPLE

The invention is further illustrated by the following non-limiting example.

An EGR mixer is constructed comprising ten apertures in five sets of two disposed along the housing inner wall that defines, together with the housing outer wall, the inner cavity. The diameter of the EGR mixer's exhaust gas inlet comprises a diameter of approximately 30 mm. The diameters of each aperture in the first set of two apertures furthest from the exhaust gas inlet are approximately 10.42 mm. The diameters of each aperture in the second set of two apertures closer to the exhaust gas inlet are approximately 9.94 mm. The diameters of each aperture in the third set of two apertures are approximately 9.46 mm. The diameters of each aperture in the fourth set of two apertures are approximately 8.98 mm. The diameters of each aperture in the fifth set of two apertures, closest to the exhaust gas inlet, are approximately 8.50 mm. The sum of the areas of an axial cross-section of each of the ten apertures is substantially equal to the area of an axial cross-section of the exhaust gas inlet, which is substantially 706 $mm^2$.

The apertures are oriented so that the apertures in the set of two furthest from the exhaust gas inlet are each at a 156° angle from either side of the longitudinal axis of the exhaust gas inlet (one measured clockwise, the other counterclockwise). The apertures of the next set closer to the exhaust gas inlet are at 122° angles. The apertures of the third set are at 86° angles, the apertures of the fourth set are at 70° angles, and the apertures of the fifth set, closest to the exhaust gas inlet, are at 14° angles. The axial cross sections of the apertures are oriented at approximately 90° from the longitudinal axis of the chamber defined within the housing inner wall.

The inner diameter of the housing outer wall is 78 mm, the inner diameter of the housing inner wall is 60 mm, and the walls are offset by approximately 3 mm in relation to each other so that the space defined by the two walls (i.e., the distance between the two walls) at a point closest to the exhaust gas inlet is larger than the distance between the two walls at a point furthest from the EGR gas inlet.

The EGR mixer performs so that NOx emissions reduction and EGR rate are improved and so that EGR mixing is improved.

The preceding examples can be repeated with similar success by substituting the generically or specifically described components, mechanisms, materials, and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An internal combustion engine system comprising:

an internal combustion engine comprising an exhaust manifold with an exhaust outlet and an intake manifold with an intake air inlet;

a turbocharger comprising an exhaust gas turbine and a compressor, said exhaust gas turbine in fluidic connection with said exhaust outlet to receive exhaust gas; and an EGR mixer in fluidic connection with said exhaust turbine to receive exhaust gas and in fluidic connection with a fresh air inlet to receive fresh air for mixing with the exhaust gas, said EGR mixer comprising:

an outer wall;

an inner wall, said inner and said outer walls defining a cavity therebetween;

a chamber defined within said inner wall;

a plurality of apertures in said inner wall;

an exhaust gas inlet disposed on said outer wall for receiving exhaust gas into said cavity then into said chamber through said apertures, said apertures increasing in diameter with respect to increasing distance from said exhaust gas inlet;

wherein said inner wall and said outer wall are offset in relation to each other such that a distance between said inner wall and said outer wall progressively decreases from a point on the outer wall adjacent said exhaust gas inlet to a point on the outer wall radially opposite said exhaust gas inlet wherein the offset and the increasing diameters of said apertures act to moderate and optimize the flow rate of exhaust from said exhaust gas inlet to said chamber via said apertures;

a fresh air inlet at a first end of said mixer for receiving air into said chamber for mixing with exhaust gas; and an air outlet at a second end of said mixer for the exit of a mixture of fresh air and exhaust gas;

said EGR mixer in fluidic connection with said compressor so that said compressor receives a mixture of the fresh air and the exhaust gas; and said compressor in fluidic connection with said intake air inlet.

2. The EGR mixer of claim 1 wherein an axial cross-section of each of said apertures is at substantially a 90° angle with respect to a longitudinal axis of said chamber.

3. The EGR mixer of claim 1 wherein said apertures are disposed in pairs, a first aperture and a second aperture of said pair having similar angular positions about said chamber, an angle of said first aperture measured counterclockwise from a longitudinal axis of said exhaust gas inlet and an angle of said second aperture measured clockwise from a longitudinal axis of said exhaust gas inlet.

4. The EGR mixer of claim 1 wherein a sum of an axial cross-sectional area of each of said apertures is substantially equal to an axial cross-sectional area of said exhaust gas inlet.

5. An EGR system for use with an internal combustion engine, the engine having an exhaust manifold with an exhaust manifold outlet and an intake manifold with an intake manifold air inlet, said system comprising:

a low pressure EGR loop in fluidic connection with the exhaust manifold outlet and the intake manifold air inlet;

a turbocharger having an exhaust gas turbine and a compressor;

an EGR mixer downstream of said exhaust gas turbine, with a first portion of said low pressure EGR loop in fluidic connection with said EGR mixer and with said exhaust gas turbine to receive exhaust gas from said exhaust gas turbine;

a fresh air inlet in fluidic connection with said EGR mixer, said EGR mixer comprising:

an outer wall;

an inner wall, said inner and said outer walls defining a cavity therebetween;

a chamber defined within said inner wall;

a plurality of apertures in said inner wall;

an exhaust gas inlet disposed on said outer wall for receiving exhaust gas into said cavity then into said chamber through said apertures, said apertures increasing in diameter with respect to increasing distance from said exhaust gas inlet;

wherein said inner wall and said outer wall are offset in relation to each other such that a distance between said inner wall and said outer wall progressively decreases from a point on the outer wall adjacent said exhaust gas inlet to a point on the outer wall radially opposite said exhaust gas inlet wherein the offset and the increasing diameters of said apertures act to moderate and optimize the flow rate of exhaust from said exhaust gas inlet to said chamber via said apertures;

a fresh air inlet at a first end of said mixer for receiving air into said chamber for mixing with exhaust gas; and an air outlet at a second end of said mixer for the exit of a mixture of fresh air and exhaust gas;

a second portion of said low pressure EGR loop in fluidic connection with said EGR mixer and with said compressor; and a third portion of said low pressure EGR loop in fluidic connection with said compressor and with said intake manifold air inlet.

6. The EGR mixer of claim 5 wherein an axial cross-section of each of said apertures is at substantially a 90° angle with respect to a longitudinal axis of said chamber.

7. The EGR mixer of claim 5 wherein said apertures are disposed in pairs, a first aperture and a second aperture of said pair having similar angular positions about said chamber, an angle of said first aperture measured counterclockwise from a longitudinal axis of said exhaust gas inlet and an angle of said second aperture measured clockwise from a longitudinal axis of said exhaust gas inlet.

8. The EGR mixer of claim 5 wherein a sum of an axial cross-sectional area of each of said apertures is substantially equal to an axial cross-sectional area of said exhaust gas inlet.

* * * * *